US006041721A

United States Patent [19]

Weston

[11] Patent Number: 6,041,721

[45] Date of Patent: Mar. 28, 2000

[54] LATCH

[75] Inventor: Peter W. Weston, Lewes, United Kingdom

[73] Assignee: Roger H. Richardson, Teddington, United Kingdom

[21] Appl. No.: 08/783,430

[22] Filed: Jan. 16, 1997

[30] Foreign Application Priority Data

Jan. 16, 1996 [GB] United Kingdom ..... 9600865

[51] Int. Cl.[7] ..... A47B 57/00

[52] U.S. Cl. ..... 108/65; 292/DIG. 49; 108/64

[58] Field of Search ..... 108/65, 64, 69; 292/200, DIG. 49, 63, 66, 113

[56] References Cited

U.S. PATENT DOCUMENTS

| | | | |
|---|---|---|---|
| 3,670,371 | 6/1972 | Swanson | 292/DIG. 49 X |
| 4,159,137 | 6/1979 | Richter | 292/DIG. 49 X |
| 4,218,081 | 8/1980 | Johnson | 292/66 |
| 4,326,739 | 4/1982 | Schlueter | 292/DIG. 49 X |
| 4,352,513 | 10/1982 | Gunther | 292/DIG. 49 X |
| 5,257,839 | 11/1993 | Nielsen et al. | 292/DIG. 49 X |
| 5,271,649 | 12/1993 | Gromotka | 292/113 |
| 5,445,422 | 8/1995 | Weinerman et al. . | |
| 5,462,318 | 10/1995 | Cooke | 292/200 |

*Primary Examiner*—Jose V. Chen
*Attorney, Agent, or Firm*—Alix, Yale & Ristas, LLP

[57] ABSTRACT

A latch comprises a latch plate, suitable for mounting on the underside of a table leaf, and a lever body which carries a claw, the lever body being suitable for pivotal mounting on the underside of an adjacent table leaf via a base plate. A retaining element, having notches for engaging the claw, prevents the lever body from hanging loose when in the unlatched state of the latch.

21 Claims, 3 Drawing Sheets

LATCH

BACKGROUND OF THE INVENTION

1. Field of the Invention

The present invention relates to toggle or over-center latches, and particularly though not exclusively to toggle latches used for joining together the leaves of extendable table tops.

2. Description of the Prior Art

Toggle latches are well known in the art, and are often used for locking cases, such as suitcases.

A toggle latch generally comprises a base plate, a lever body pivotally mounted on the base plate, a sprung claw pivotally carried on the lever body, and a separate curved latch plate. The latch plate is fitted to the edge of one case half, and the base plate assembly is fitted to an opposing edge of the other case half.

The latch is latched by pivoting the lever body up and forward towards the latch plate so that the claw passes over the curved portion of the latch plate. The lever body is then pivoted back from the latch plate and pushed down to its home position flat against the case. This causes the claw to be drawn against and hooked by the curved portion of the latch plate. As the lever body is pushed down, the claw is put into tension, and the end of the claw which is mounted on the lever body is moved past an over-center position. On moving past the over-center position, the tension in the claw urges the lever body to rotate about its pivot point towards the base plate, thereby pulling the latch plate and the lever body together and urging the lever body into its home position flat against the case. This action causes the case halves to close firmly together.

To release the latch, the lever body is pivoted upwards against the tension in the claw, past the over-center position, and towards the latch plate, so that the claw becomes loose. The claw may then be easily disengaged from the latch plate, and the case may be opened.

Such latches are not only used for locking cases, and may be used in many different situations. In one particular use with which the present invention is particularly concerned, a number of latches are mounted on the underside of the leaves of an extendable table top, along the edges where the leaves abut one another, to fasten the leaves firmly together.

Such toggle latches are simple, compact and work well. The inventor of the present invention, however, has identified a problem with them in that, when in the unfastened condition, the claw (and usually also the lever body) hang loose. This is not necessarily a problem with for example cases, as these are usually kept closed with the latches latched. However, problems can occur when the latches are used with for example table top leaves, as the additional leaves for extending the table will for most of the time be stored away, with the latches in their unlatched state. In such situations, the claw and lever body of each latch hang freely from the flat underside of the leaves, and may cause scratching and other damage, with the possibility of catching on other objects.

SUMMARY OF THE INVENTION

The present invention aims to overcome the above-discussed problem, and, viewed from one aspect, provides a toggle or over-center latch including means for holding a claw of the latch in a home position when the latch is unlatched.

Viewed from a further aspect, the present invention provides a toggle or over-center latch assembly including a base plate, a lever body pivotally mounted to the base plate, a claw mounted to the lever body, and a latch plate, wherein the latch includes retaining means for holding the claw in a home position when the claw is not engaged with the latch plate.

The invention provides a toggle/over-center latch in which the claw is prevented from hanging loose and causing damage. The lever body may also be held in a home position when unlatched by the same or a different retaining means, or may be prevented from movement by the retained claw or by other means, such as a secondary lock, as discussed below.

The invention is especially useful when the latch is to be left unlatched for long periods of time, such as when used with furniture, due to the problems mentioned above. The invention therefore extends particularly to extendable tables in which the leaves of the tables are fastened together by latch assemblies as described above, and, in preferred embodiments, as also detailed further below.

The retaining means may take any suitable form, and may be arranged so that the claw is clipped into place in its home position.

In a commonly known form, the claw comprises a substantially U-shaped sprung wire.

In a preferred form, the retaining means includes means, such as opposed arms, into or between which the sides of the claw are pressed, the sides of the claw being pressed inwards somewhat by the retaining arms. The retaining arms may be shaped, e.g. by including notches therein, so that the sides of the claw after being pressed together are able to return to a substantially relaxed state while being held in place.

In an alternative form, the sides of the claw clip over and extend on either side of the retaining means, the claw sides being urged apart by the retaining means to provide suitable latching resistance. Again, the retaining means may be suitably shaped, e.g. by including notches therein, to allow the claw to return to a substantially relaxed state while being held.

The claw is normally curved in shape, and the height of for example the notches of the retaining means will depend on where along the length of the claw the retaining means is to engage the claw. A notch which is further above the latch base plate will generally engage the claw at a point further from where the claw is mounted to the lever body.

The retaining means may be separate from, a part of, or mounted on the base plate on which the lever body pivots.

In a particularly preferred form, the retaining means comprises suitably shaped end or side flange portions of the base plate. Toggle latch base plates normally comprise a metal blank with folded portions providing for example opposed flanges between which a pivot pin for the lever body may be mounted. By forming the retaining means in a similar manner, the manufacture of the latches is kept simple.

In one preferred form, the retaining means comprises an upturned flange portion provided at the end of the base plate which is distal in use from the latch plate, the flange portion preferably having a top portion which curves downwardly at its sides for guiding the sides of the claw on either side of the flange, and preferably a pair of opposed notches, one on either side of the flange, in which the sides of the claw may be held. In another embodiment, the end flange comprises a pair of opposed tabs extending out from the sides of the base plate, the claw being clipped over these tabs to be held beneath them. In a further end flange embodiment, the end flange includes a pair of opposed arm portions between which the claw is gripped, the arms preferably having opposed notches therein along their inner edges for holding the claw therein.

In a still further embodiment, the base plate may be channeled, and the retaining means may comprise opposed flange portions extending from the upstanding sides of the channel. In one such form, the flange portions comprise a sideways extending tab mounted at the rear end of each channel side. In a further such embodiment, an arm extends up from the end of each channel side, each arm preferably having a notch therein.

The retaining means may take advantage of the fact that the claw may be sprung to provide a clipping action. In a further embodiment, however, the retaining means itself is sprung to aid in the clip retention of the claw, and may for example be made from flat sprung steel and be provided separately from the base plate. Such embodiments may be used with stiff claws and/or to reduce the force required to clip the claw in place.

The claw and lever body may be arranged such that, when the claw is retained in its home position, it also holds the lever body in place and prevents this too from hanging loose or moving excessively. This may be achieved, for example when using a U-shaped sprung wire claw, by providing a lever body which in the home position extends further back in the direction of the base plate than does the claw, so that when in their flat home positions the bridge of the claw is above the top surface of the lever body thereby preventing the lever body from pivoting upwards.

Alternatively, separate means way be provided for holding the lever body in place. These may take the form of a secondary lock. Such a lock may comprise a hooked locking spring mounted on the base plate and passing through an aperture in the top surface of the lever body, the hook needing to be pushed out of engagement with the edge of the aperture before the lever body can be pivoted upwards. Such is secondary locks are known in the art and are used to prevent accidental raising of the lever body, and so opening of the latch, after the latch has been closed (it should be noted that these secondary locks were not made with the intention of preventing the lever body from moving whilst in its unlatched condition but rather whilst in its locked condition).

Where such a secondary lock or other means (such as spring biasing of the lever body, a hasp or other pin retaining means) is used to hold the lever body flat in place, the retaining means may be on the lever body itself. Thus, the retaining means may comprise protrusions or other means either side of the lever body over or into which the claw may be clipped, so as to hold the claw in place.

BRIEF DESCRIPTION OF THE DRAWING

Embodiments of the present invention will now be described, by way of example only, with reference to the accompanying drawing, in which.

DESCRIPTION OF THE DISCLOSED EMBODIMENTS

Figure 1:
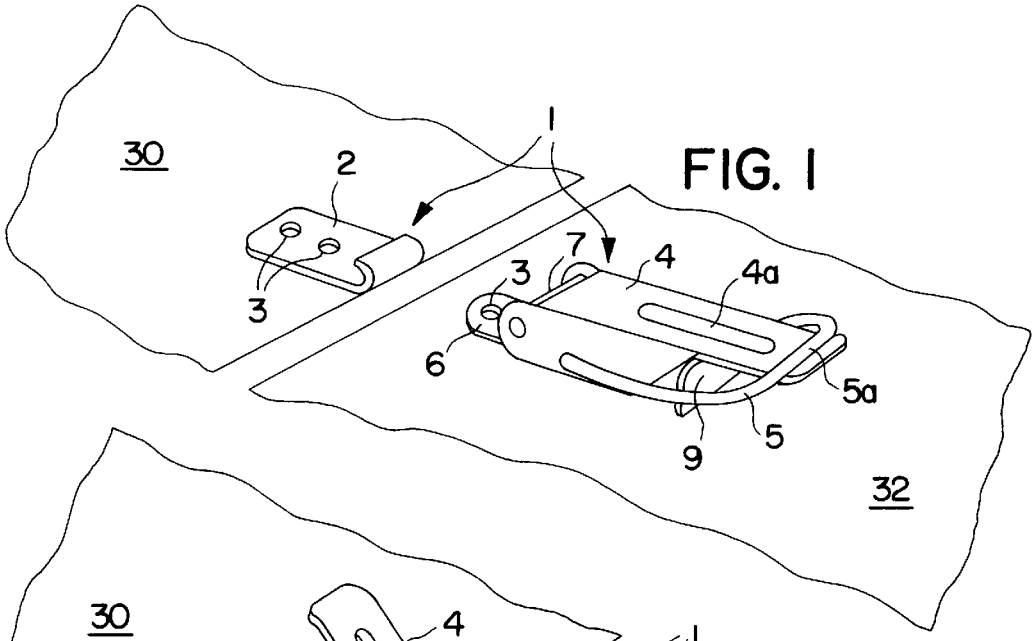
FIGS. 1–3 show in perspective a latch according to one embodiment of the present invention schematically mounted to a table or a table leaf, the latch being shown, respectively, released, in the process of being latched, and fully latched.

Referring to FIGS. 1–7, a latch 1 is shown which may be used for a number of different purposes. It may for example be mounted on the underside of abutting edges of leaves 30 of an extendable table top 32 to fasten the leaves together.

The latch 1 comprises a curved latch plate 2, which in use would be mounted by locating screws 3 to for example an underside edge of one table leaf, and a lever body 4 carrying a U-shaped sprung wire claw 5 and pivotally mounted on a base plate 6 which in use would be affixed also by locating screws 3 to an underside edge of a table leaf to be fastened to the first leaf.

The lever body 4 is pivotally mounted to the base plate 6 by a pin 7 carried between opposed flange portions 8 of the base plate 6. The lever body 4 includes an indented rib 4*a* therein for stiffness.

In accordance with the present invention, the base plate 6 also includes claw retaining means. In the embodiment being described, the retaining means is in this case in the form of an end flange portion 9 which has notches 10 therein for receiving the side wire portions of the claw 5 when the latch is in its released position as shown in FIG. 1. The top of the flange portion 9 also has a notch therein for accommodating the indented rib 4*a* of the lever body 4.

Figure 2:
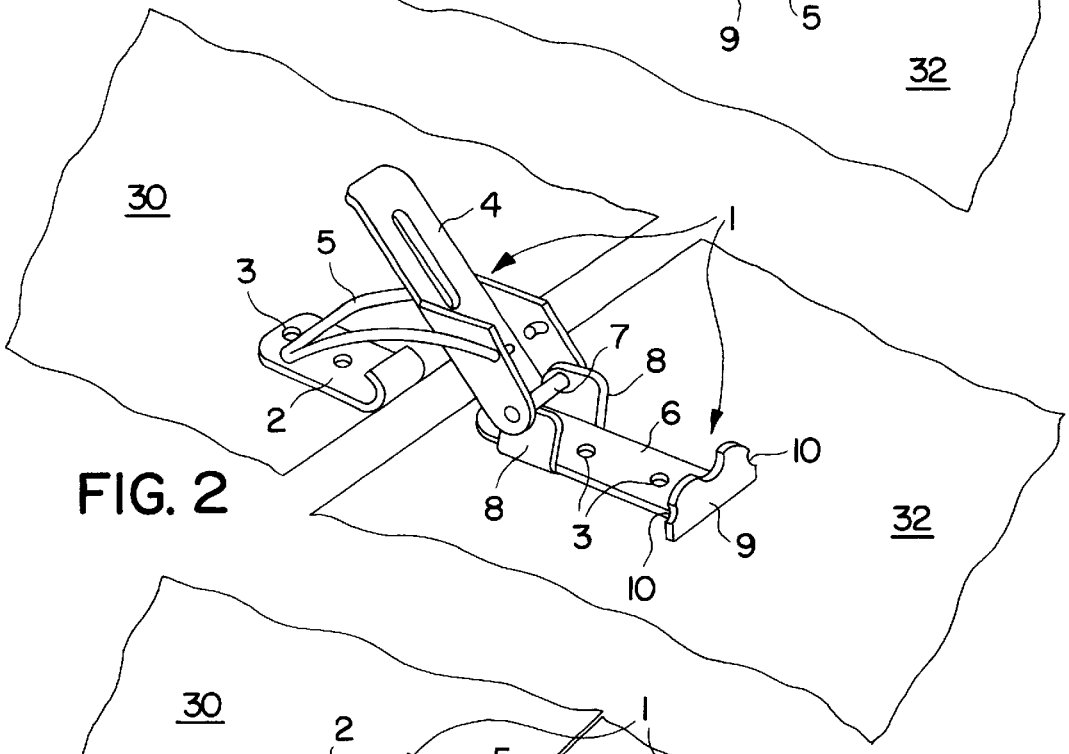

The latch 1, in use, may be moved from an unlatched to a latched position by pivoting the lever body 4 upwardly as shown in FIG. 2, so that the claw 5 passes over the curved portion of the latch plate 2. The lever body 4 is then pivoted back down to its home position. As the lever body 4 is moved, the claw 5 engages with the curved end of the latch plate 2 and is tensioned as the lever body 4 continues to pivot.

Figure 3:
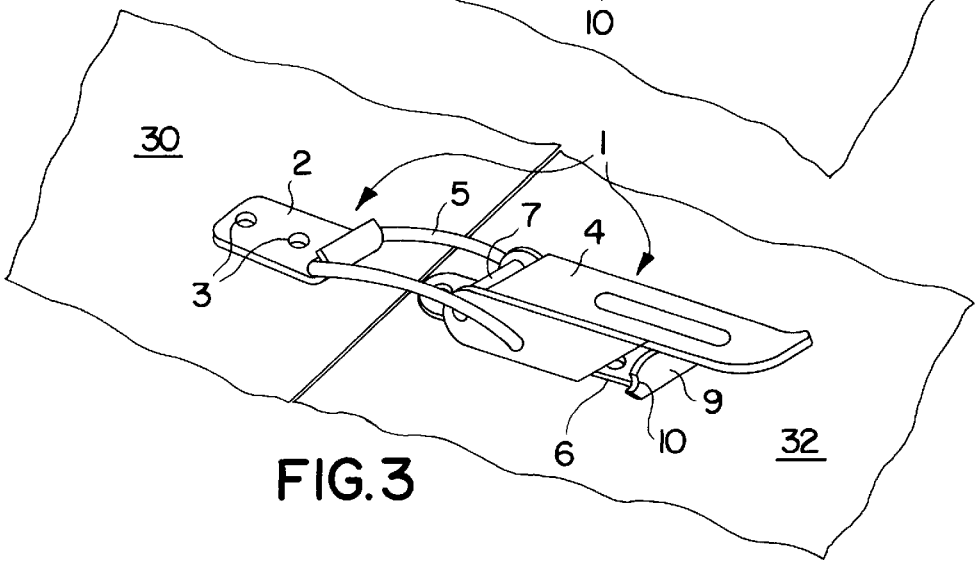

In moving to the position shown in FIG. 3, the lever body and claw pass through an over-center position in which the claw hinge point, the lever pivot point and the point of engagement of the claw and latch plate are aligned, after which position the tension in the claw acts to rotate the lever body 4 clockwise (when viewed as in FIGS. 1–3) to thereby pull the latch plate and lever body together and to urge the lever body 4 into its flat home position. This causes the table leaves on which the latch plate and base plate assemblies are mounted to be held firmly in contact with one another.

To release the latch, the lever body 4 is pivoted upwards past the over-center position and towards the latch plate 2, so that the claw 5 becomes loose and may be unhooked from the latch plate 2.

In contrast to the prior art, after the latch 1 has been unlatched, the claw 5 need not be left to hang loose, but may be held in position between the two notches 10 of the flange portion 9 as shown in FIG. 1. Further, because the lever body 4 extends further back in the direction of the base plate 6 than does the claw 5, the bridge portion 5*a* of the claw 5 prevents the lever body 4 from rotating upwardly. Thus, the retaining means 9,10 prevents the claw 3 and lever body 4 from hanging loose when the leaves are not in use and stored away, and so prevents the latch from scratching or otherwise damaging the leaves and other objects, or from snagging on other objects.

The arrangement of this particular embodiment also has the advantage that the latch 1 may be opened in one action, as movement of the lever body 4 upwards also causes the claw 5 to be pulled out of its retained position.

Figure 4:
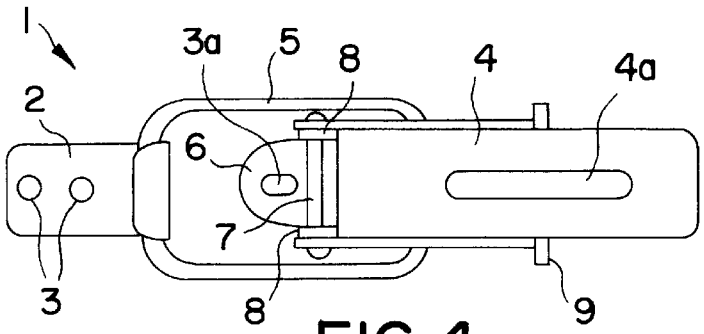
FIG. 4 is a top plan view of the latch as shown in FIG. 3.
Figure 5:
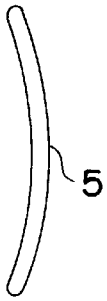
FIGS. 5 and 6 are respectively side and top plan views of the claw used in the embodiment of FIGS. 1–3.
Figure 6:
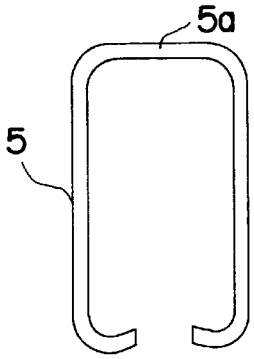
Figure 7:
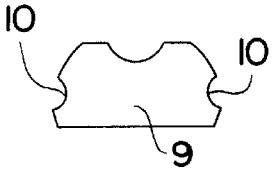
FIG. 7 shows an end elevation of the claw retaining means of the embodiment of FIGS. 1–3.

As best seen in FIG. 4, to facilitate the mounting of the base plate 6 in its correct position on a leaf, it has an elongate hole 3*a* in a portion thereof which extends forwardly of the lever body 4. This allows the position of a drill hole, corresponding to the screw hole 3*a*, to be easily marked on the leaf by a pencil whilst the lever body 4 is positioned in its latched home state, with the claw 5 engaging the latch plate 2. The drill hole establishes a reference point for the mounting of the base plate 6 which allows the remaining drill holes (corresponding to base plate screw holes below the lever body 4) to be easily marked out, while the base plate assembly is unlatched.

Figure 8:
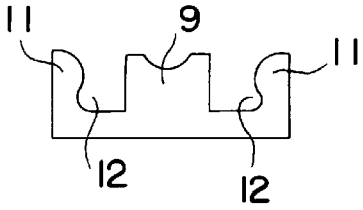
FIG. 8 is an end elevation view of an alternative claw retaining means which may be used with the latch of FIGS. 1–3, as a second embodiment of the invention.

FIG. 8 shows an alternative to the retaining means of the first embodiment, in which the flanged portion 9 takes the form of a pair of opposed arms 11 with notches 12 on their inner edges, and in which the sprung claw 4 is clipped into position by being pressed between the opposed arms 11 to lie in the notches 12.

Figure 9:
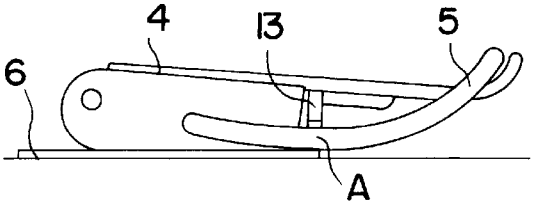
FIG. 9 is a side elevation view of a latch according to a third embodiment of the present invention.
Figure 10:
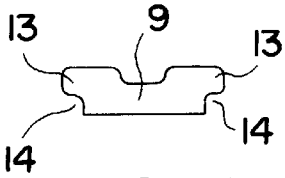
FIG. 10 is an end elevation view of the claw retaining means used in the FIG. 9 embodiment.

The embodiment of FIGS. 9 and 10 is similar to that of the first embodiment, except that the end flange 9 has a different shape, and comprises tabs 13 extending out from the sides of the base plate 6. These tabs 13 define notches 14 therebelow in which the claw 5 is retained. Due to the curvature of the claw 5, and because the notches 14 are lower than in the first embodiment, they engage the claw 5 at a point A which is nearer to where the claw is pivotally mounted on the lever body 4. This embodiment therefore allows the base plate 6 to be lower, and may provide a thinner more compact latch.

Figure 11:
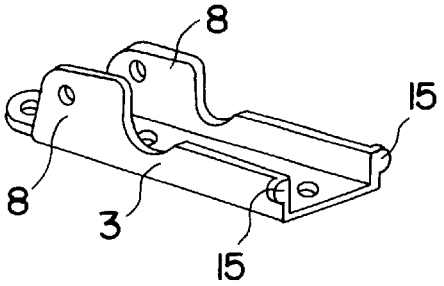
FIG. 11 shows the base plate of a latch according to a fourth embodiment of the present invention.

FIG. 11 shows a further embodiment similar to that of FIGS. 9 and 10, but with the retaining means comprising tabs 15 extending from the upstanding sides of a channeled base plate 3.

Figure 12:
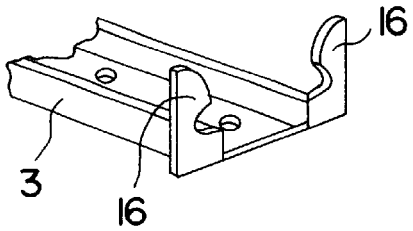
FIG. 12 shows the end of a base plate of a latch according to a fifth embodiment of the present invention.

FIG. 12 shows the end of a channeled base plate 3 with a further retaining means thereon in the form of a pair of opposed arms 16 extending upwardly on either side of the base plate channel.

Figure 13:
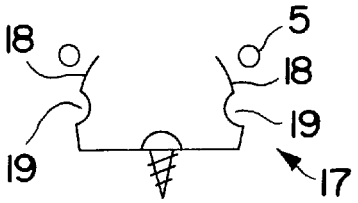
FIGS. 13–16 show various further possible embodiments of a claw retaining means according to the present invention.
Figure 14:
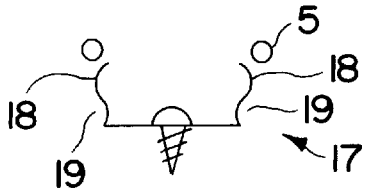
Figure 15:
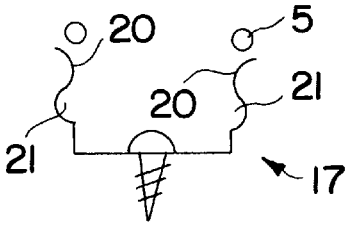
Figure 16:
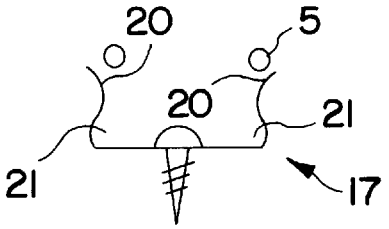

FIGS. 13–16 show various other designs of retaining means 17 which are made from flat sprung steel. These are formed separately from the base plates 6, and may be mounted adjacent to them by, for example, locating screws. In the designs of FIGS. 13 and 14, the claw 5 is pushed over the outside of the retaining means, so that it is first expanded by the portions 18 and then held in a substantially relaxed state in the notch portions 19. In the designs of FIGS. 15 and 16, the sides of the claw 5 are first pressed together by portions 20 and then held in a substantially relaxed state in notched portions 21. As these designs are made from sprung steel, they are able to flex to aid in the clipping action.

Figure 17:
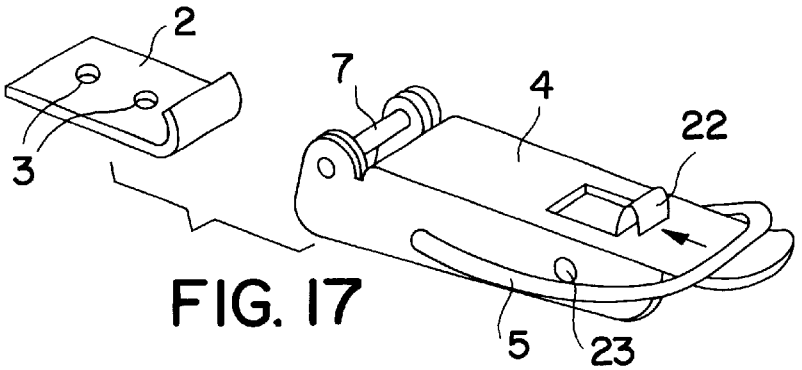
FIG. 17 shows a latch having a secondary look for the lever body, and a claw retaining means mounted on the lever body.

FIG. 17 shows a further embodiment of the invention, in which the latch 1 includes a secondary, hooked, lock spring 22 for holding the lever body 5 in its home position. Such secondary locks are known, and are used to prevent the latch 1 from being accidentally opened, once locked, by an object or someone accidentally knocking against the end of the lever body 4 and pushing it upwards (Other means such as using a hasp, other pin retaining means or spring biasing of the lever body into its home position are also known for this purpose). Although not the main intention, such secondary locks have the added advantage of also holding the lever body 5 in place when the latch is open (but do not of course prevent the claw 5 from hanging loose). In such latches, the claw retaining means may be mounted on the lever body 4, and, in the embodiment shown, comprises a rounded protrusion 23 on each side of the lever body 4, over which the sides of the claw 4 clip.

The above are only preferred embodiments of the present invention, and various alternatives and modifications to the above are also possible. The latches need not only be used with table leaves, but may be used in any suitable situation, such as to lock a case.

What is claimed is:

1. A toggle or over-center latch having a latched condition and an unlatched condition, said latch comprising:

a base;

a lever body pivotably mounted to said base and having a lever home position;

a claw pivotably mounted to said lever body and having a latched position and a claw home position; and retaining means adjacent said base for clipable engagement with said claw in the claw home position;

wherein said claw is held in the claw home position when clipped into engagement with said retaining means to retain said lever body in the lever home position.

2. The latch of claim 1, wherein the claw comprises a substantially U-shaped element.

3. The latch of claim 2, wherein said retaining means has a pair of opposite sides and said U-shaped element includes a pair of spaced side arms which extend on either side of said retaining means when the latch is in the unlatched condition and said claw is in said home position.

4. The latch of claim 3, wherein the retaining means comprises a pair of tabs over which the claw is clipped.

5. The latch of claim 3, wherein the retaining means includes a top portion which curves downwardly at its sides for guiding the side arms of the claw to either side thereof.

6. The latch of claim 5, wherein the retaining means includes notches therein in which the claw is held.

7. The latch of claim 1, wherein the claw is pressable into or between the retaining means.

8. The latch of claim 7, wherein said retaining means defines notches which clipably engage said claw.

9. The latch of claim 7, wherein the retaining means comprises arms between which the claw is held.

10. The latch of claim 1, wherein the lever body is held in a home position when unlatched.

11. The latch of claim 10, wherein the lever body is held in its home position by a secondary lock.

12. The latch of claim 11, wherein the secondary lock comprises a hooked locking spring mounted on the base plate which engages with an aperture in the top surface of the lever body.

13. The latch of claim 10, wherein the lever body is held in its home position by pin means.

14. The latch of claim 10, wherein the lever body is held in its home position by a spring bias.

15. The latch of claim 10, wherein the retaining means is mounted on or is a part of the lever body.

16. The latch of claim 10, wherein the retaining means comprises means on either side of the lever body for engaging the claw.

17. A toggle or over-center latch assembly including a base plate, a lever body pivotally mounted to said base plate, a sprung wire claw having a latched position and a home position mounted to said lever body, and a latch plate for engagement with said claw in the latched position, wherein the latch assembly further includes retaining means for clipable engagement with said claw whereby said claw is held in the home position when clipped into engagement with said retaining means.

18. A toggle or over-center latch comprising:

a base;

a lever body pivotably mounted to said base and having a lever home position;

a claw mounted to said lever body and having a claw latched position and a claw home position; and retaining means included with said base for clipable engagement with said claw in the claw home position;

wherein said lever body is retained in the lever home position by said retaining means and said claw when said claw is clipably engaged with said retaining means.

19. The latch of claim 18, including:

a latch plate engageable with said claw in the claw latched position mounted to a first part; and a second part mounted to said base;

wherein said first part abuts said second part when said claw engages said latch plate.

20. The latch of claim 19, wherein the first part comprises one of an underside of a table or an underside of a table leaf, and the second part comprises the other of the underside of the table or the underside of the table leaf.

21. A toggle or over-center latch including:

a base;

a lever body pivotably mounted to said base and having a home position;

a claw having a claw home position, said claw comprising a U-shaped element having spaced side arms mounted at a first end to said lever body and interconnected at an opposing second end by a bridge; and retaining means included with said base for clipable engagement with said claw in the claw home position;

wherein said lever is trapped between said retaining means and said bridge when said claw is clipably engaged with said retaining means.

* * * * *